US005980304A

United States Patent [19]

Lin

[11] Patent Number: 5,980,304

[45] Date of Patent: Nov. 9, 1999

[54] DECORATION LAMP SOCKET

[76] Inventor: Mei-Lu Lin, 56, Minsheng Street, Fengyuan, Taichung Hsien, Taiwan, 420

[21] Appl. No.: 09/012,925

[22] Filed: Jan. 24, 1998

[51] Int. Cl.[6] ..... H01R 4/24

[52] U.S. Cl. ..... 439/419; 439/188

[58] Field of Search ..... 439/419, 188

[56] References Cited

U.S. PATENT DOCUMENTS

| | | | |
|---|---|---|---|
| 5,595,493 | 1/1997 | Chen | 439/419 |
| 5,634,812 | 6/1997 | Chen | 439/419 |
| 5,643,006 | 7/1997 | Wang et al. | 439/419 |
| 5,743,758 | 4/1998 | Cheng et al. | 439/419 |

*Primary Examiner*—Paula Bradley
*Assistant Examiner*—Tho D. Ta

[57] ABSTRACT

A decoration lamp socket has a socket body, a socket cap covering the socket body, and an electric wire set having a first wire and a second wire disposed between the socket cap and the socket body. The socket cap has two positioning plates and two grooves receiving the wires. A first metal contact plate has a first tip end. A second metal contact plate has a second tip end. A center copper plate has a distal end plate, a conductive end, and a curved portion. A conductive plate has a main body, a bent end, and an elastic extension which includes a plurality of bends and a transverse upper end. The socket body has two slots receiving the positioning plates, a first hole receiving the first metal contact plate, a second hole receiving the second metal contact plate, a third hole receiving the conductive plate, and a fourth hole receiving the center copper plate.

1 Claim, 4 Drawing Sheets

DECORATION LAMP SOCKET

BACKGROUND OF THE INVENTION

This invention relates to a lamp socket, and more particularly to a decoration lamp socket which is adapted to receive a decoration bulb.

Referring to FIG. 1, a conventional lamp socket has a socket body 1, a base 8 inserted in the socket body 1, a lamp bulb 9 disposed on the base 8, and a socket cap 2 covering the socket body 1. Two electric wires 7 are disposed between the socket cap 2 and the socket body 1. A first metal contact plate 3 and a second metal contact plate 6 are disposed in the socket body 1. A conductive plate 5 having a projecting strip 51 contacts the first metal contact plate 3. A metal spring plate 4 contacts the second metal contact plate 6. However, the metal spring plate 4 will not contact the second metal contact plate 6 after a long period of usage.

SUMMARY OF THE INVENTION

An object of this invention is to provide a decoration lamp socket which has improved copper plates.

Another object of this invention is to provide a decoration lamp socket which can be assembled easily.

In accordance with a preferred embodiment of this invention, a decoration lamp socket comprises a socket body, a socket cap covering the socket body, and an electric wire set having a first wire and a second wire disposed between the socket cap and the socket body. The socket cap has two opposite positioning plates and two grooves receiving the first wire and the second wire. A first metal contact plate has a first tip end. A second metal contact plate has a second tip end. A center copper plate has a distal end plate, a conductive end, and a curved portion. A conductive plate has a main body, a bent end, and an elastic extension which includes a plurality of bends and a transverse upper end. The socket body has two slots receiving the positioning plates, a first hole receiving the first metal contact plate, a second hole receiving the second metal contact plate, a third hole receiving the conductive plate, and a fourth hole receiving the center copper plate.

DETAILED DESCRIPTION OF THE INVENTION

Figure 1:
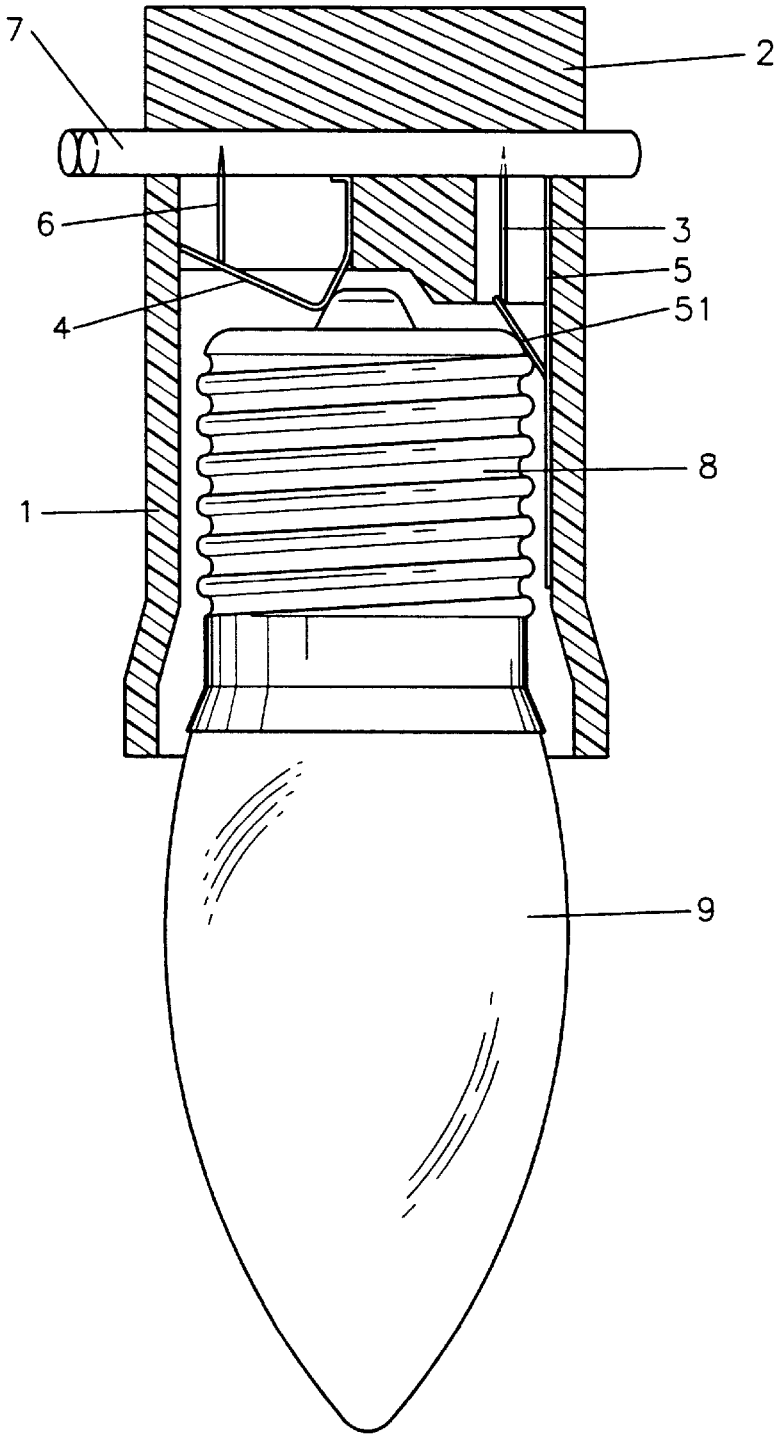
FIG. 1 Prior Art
FIG. 1 is a sectional assembly view of a conventional lamp socket of the prior art and a lamp bulb.
Figure 2:
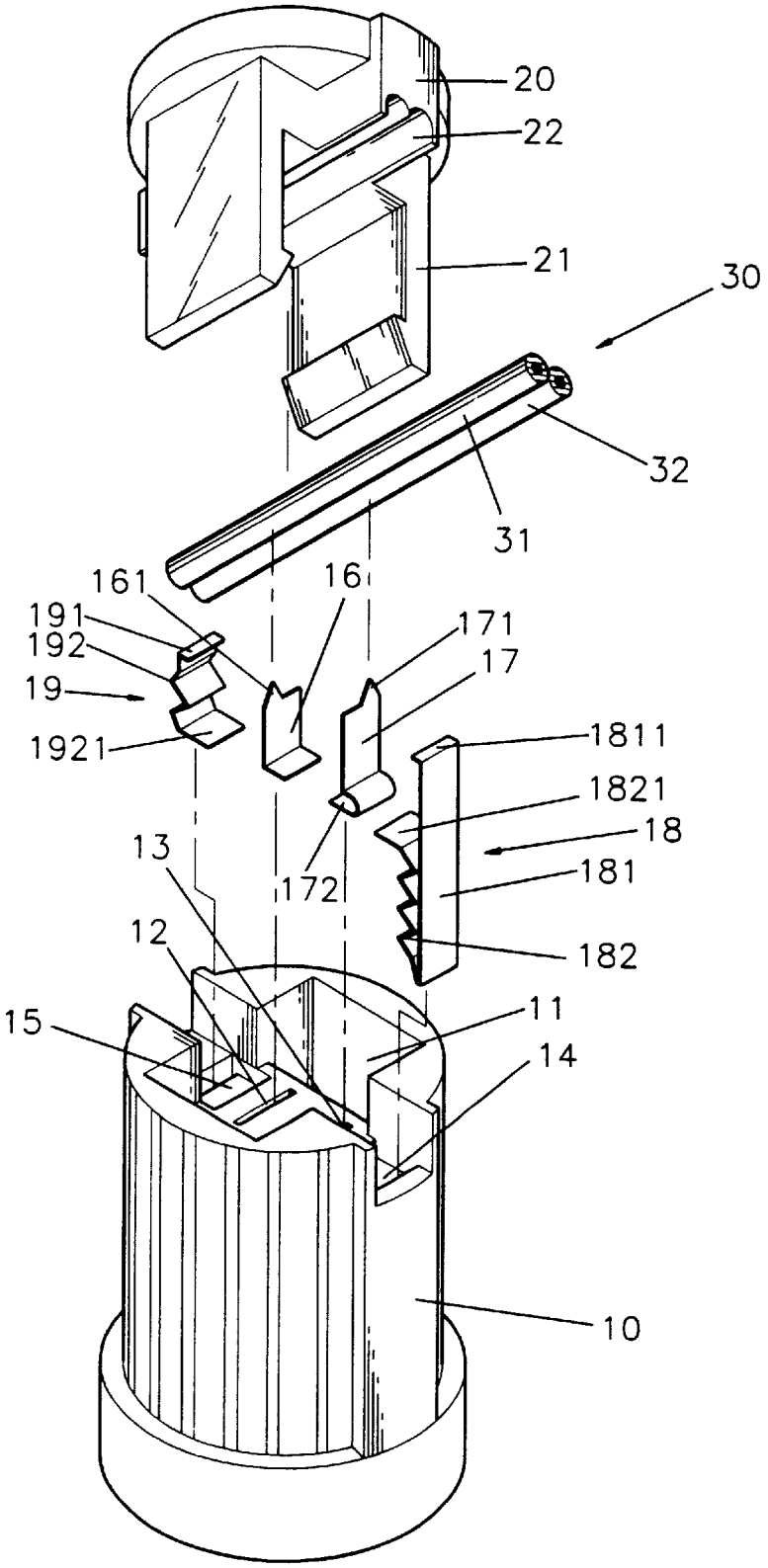
FIG. 2 is a perspective exploded view of a decoration lamp socket of a preferred embodiment.
Figure 3:
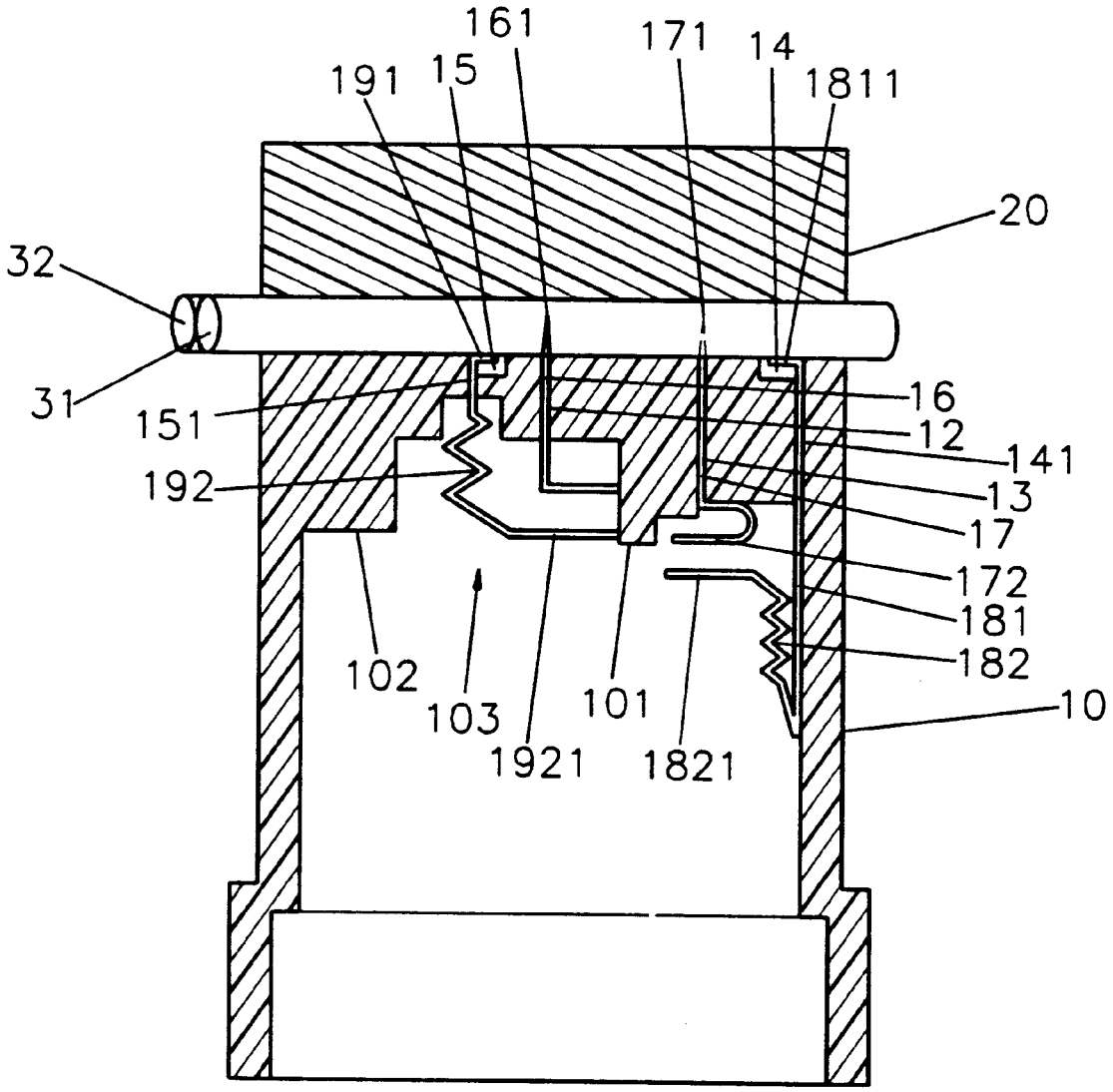
FIG. 3 is a sectional assembly view of FIG. 2.
Figure 4:
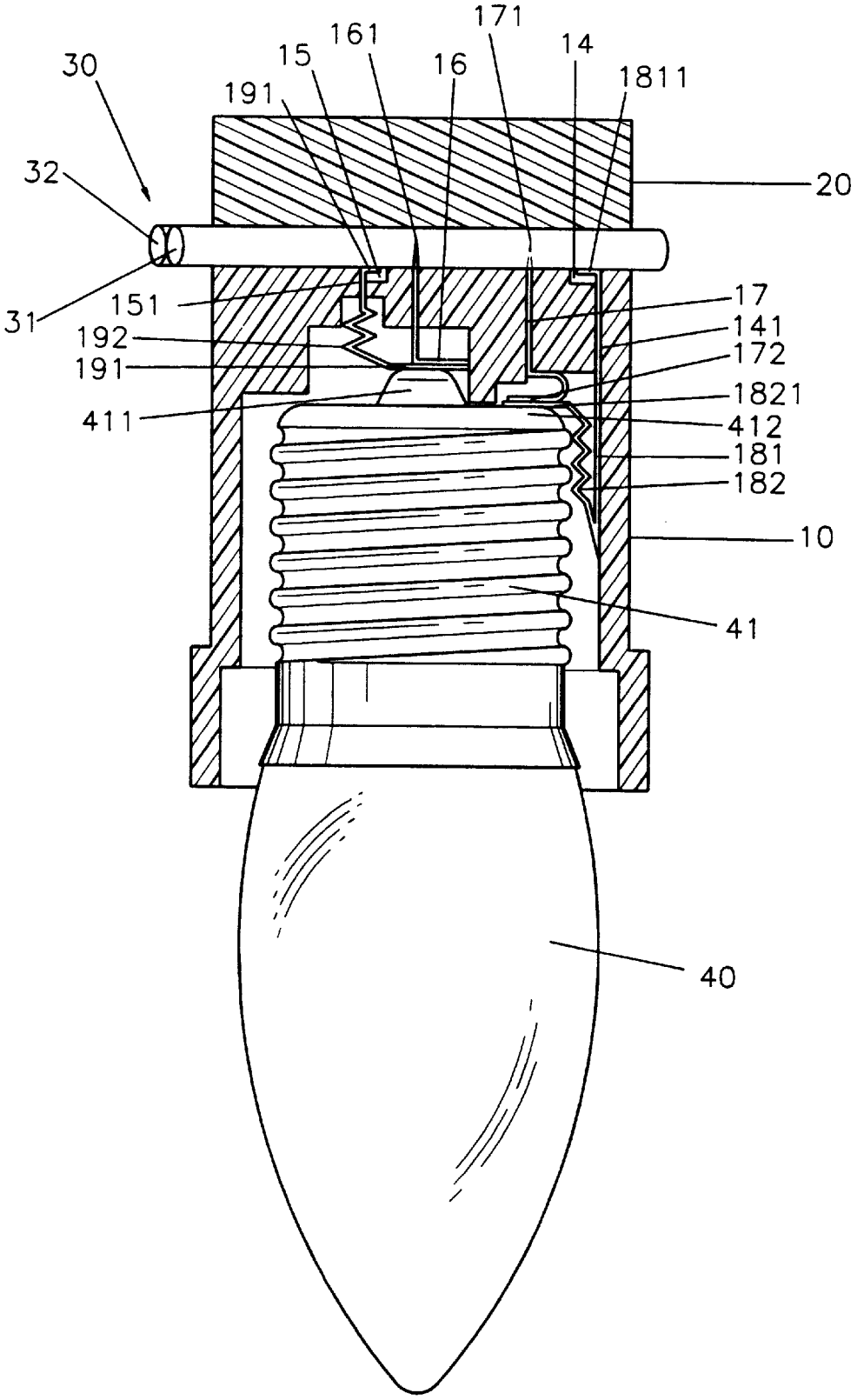
FIG. 4 is a sectional assembly view of FIG. 2 and a lamp bulb.

Referring to FIGS. 2 to 4, a decoration lamp socket comprises a socket body 10, a socket cap 20 covering the socket body 10, and an electric wire set 30 having a first wire 31 and a second wire 32 disposed between the socket cap 20 and the socket body 10. The socket cap 20 has two opposite positioning plates 21 and two grooves 22 receiving the first wire 31 and the second wire 32. A first metal contact plate 16 has a first tip end 161 and an arcuate end 172. A second metal contact plate 17 has a second tip end 171. A center copper plate 19 has a distal end plate 1921, a conductive end 191, and a curved portion 192. A conductive plate 18 has a main body 181, a bent end 1811, and an elastic extension 182 which includes a plurality of bends and a transverse upper end 1821. The socket body 10 has two slots 11 receiving the positioning plates 21, a first hole 12 receiving the first metal contact plate 16, a second hole 13 receiving the second metal contact plate 17, a third hole 14 receiving the conductive plate 18, and a fourth hole 15 receiving the center copper plate 19.

A base 41 is inserted in the socket body 10. A lamp bulb 40 is disposed on the base 41. The base 41 has a bottom 412 contacting the projecting plates 1821, and a tip 411 contacting the center copper plate 19.

I claim:

1. A decoration lamp socket comprises:

a socket body, a socket cap covering the socket body, and an electric wire set having a first wire and a second wire disposed between the socket cap and the socket body, the socket cap having two opposite positioning plates and two grooves receiving the first wire and the second wire;

a first metal contact plate having a first tip end, a second metal contact plate having a second tip end and an arcuate end, a center copper plate having a distal end plate, a conductive end, and a curved portion, a conductive plate having a main body, a bent end, and an elastic extending including a plurality of bends and a transverse end;

the socket body having two slots receiving the positioning plates, a first hole receiving the first metal contact plate, a second hole receiving the second metal contact plate, a third hole receiving the conductive plate, and a fourth hole receiving the center copper plate.

* * * * *